US005103521A

United States Patent [19]

Träubel et al.

[11] Patent Number: 5,103,521

[45] Date of Patent: Apr. 14, 1992

[54] LEATHER TREATMENT AGENT AND ITS USE

[75] Inventors: Harro Träubel; Manfred Dietrich, both of Leverkusen; Hans-Werner Müller; Günther Held, both of Cologne, all of Fed. Rep. of Germany

[73] Assignee: Bayer Aktiengesellschaft, Leverkusen, Fed. Rep. of Germany

[21] Appl. No.: 392,335

[22] Filed: Aug. 11, 1989

Related U.S. Application Data

[63] Continuation of Ser. No. 145,841, Jan. 19, 1988, abandoned, which is a continuation of Ser. No. 881,556, Jul. 3, 1986, abandoned.

[30] Foreign Application Priority Data

Jul. 18, 1985 [DE] Fed. Rep. of Germany ..... 3525605

[51] Int. Cl.[5] ..... C14C 3/06

[52] U.S. Cl. ..... 8/94.27; 8/94.19 R; 8/94.23; 8/436

[58] Field of Search ..... 8/94.19 R, 94.27, 94.23, 8/436

[56] References Cited

U.S. PATENT DOCUMENTS 4,106,897 8/1978 Traubel ..... 8/94.33
4,126,413 11/1978 Traubel et al. ..... 8/94.27
4,187,074 2/1980 Traubel ..... 8/94.19

FOREIGN PATENT DOCUMENTS 0705335 10/1954 United Kingdom .
1523294 8/1978 United Kingdom .

*Primary Examiner*—Prince Willis, Jr.
*Assistant Examiner*—John F. McNally
*Attorney, Agent, or Firm*—Sprung Horn Kramer & Woods

[57] ABSTRACT

Leather treatment agent containing a mixture a) of a carboxylic acid $$X—COOH \quad 1$$

wherein X represents $$—[R—CO—Z—(R'—Z)_a]_b—CO—R—COOH \quad 1$$

or $$—R''—(Z—R')_c—Z—CO—R—COOH \quad 2$$

and the symbols have the meaning described in more detail in the description, and b) of a compound containing at least one primary, secondary or tertiary amino group, with a molecular weight of 200–20,000, are used in processes for tanning, pretanning, retanning, dyeing or fat liquoring pelts or pretanned leather or fully tanned leather.

6 Claims, No Drawings

LEATHER TREATMENT AGENT AND ITS USE

This is a continuation of application Ser. No. 145,841, filed 1-19-89 now abandoned, which is a continuation of Ser. No. 881,556, filed: 7-3-86, now abandoned.

The invention relates to leather treatment agents containing a mixture a) of a carboxylic acid of the general formula $$X—COOH \qquad I$$

wherein X represents a radical of the formula $$—[R—CO—Z—(R'—Z)_a]_b—CO—R—COOH \qquad 1$$

in which a and b denote an integer from 1 to 100, preferably 1 to 20,

Z denotes $NR_1$, O or S, wherein $R_1$=H or $C_1$–$C_4$-alkyl, which can be substituted by OH or $C_1$–$C_4$-alkoxy, R denotes $C_1$–$C_2$-alkylene, which can be substituted by $NH_2$, —CH=CH—, phenylene, which can be substituted by $C_1$–$C_4$-alkyl, or a direct bond and R′ denotes $C_2$–$C_{20}$-alkylene, which can be interrupted by

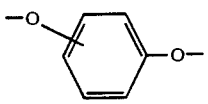

or —$NR_1$—, or denotes cyclohexylene or dicyclohexylenemethane, or represents $$—R''—(Z—R')_c—Z—CO—R—COOH \qquad 2$$

in which

Z, R and R′ have the same meaning as in formula 1, c denotes zero or an integer from 1 to 100, R″ denotes $C_1$–$C_{20}$-alkylene or phenylene, which can be substituted by $C_1$–$C_4$-alkyl, or $$R''' \begin{cases} [(Z\text{-}R')_c—Z—CO—R—COOH]_k \\ [Z—CO—R^{IV}]_l \end{cases} \qquad II$$

in which

Z, R, R′ and c have the abovementioned meaning, k denotes an integer from 1 to 6, l denotes zero or an integer from 1 to 5, k+l denotes not more than 6, R‴ denotes a k+l-valent $C_2$–$C_6$-alkylene radical and $R^{IV}$ denotes $C_1$–$C_{12}$-alkyl, phenyl, which can be substituted by $C_1$–$C_4$-alkyl, or $$—R—COOR^{V}$$

wherein $R^{V}$=$C_1$–$C_{12}$-alkyl, and the number of carboxyl groups in (I) and (II) is greater than the number of amino groups, and b) a compound containing at least one primary, secondary or tertiary amino group, with a molecular weight of 200–20,000, and their use in processes for tanning, pretanning, retanning, dyeing or fat liquoring pelt or pretanned leather or fully tanned leather.

The use of the components of the leather treatment agents according to the invention for the treatment of leather is known.

The use of compounds prepared by condensation of carboxylic acids with compounds containing hydroxyl or amino groups in a molar ratio $$\frac{COOH}{NH_2/OH} \qquad 1$$

for example the carboxylic acids of the formulae (I) and (II), as a tanning agent or retanning agent is known from German Offenlegungsschrift 2,626,430.

(Re)tanning with compounds containing amino and urethane groups is described, for example, in German Offenlegungsschrift 2,416,485 and European Patent Specification 0,001,067.

The use of polyethers containing amino groups in the dyeing of leather is known, for example, from British Patent Specification 705,335, U.S. Pat. Spec. No. 3,334,960, U.S. Pat. Spec. No. 4,272,243 and German Offenlegungsschrift 2,539,671.

The leather treatment agents according to the invention preferably contain components a) and b) in a weight ratio of 5–95:95–5. They are used, for example, as aqueous solutions.

The pH value of the ready-to-use aqueous solutions is 1.5–10, in particular 3.5–7.5. It can be established by addition of acids or alkalis.

The preferred total concentration of the mixture components a) and b) in the aqueous solutions is 20–60% by weight.

The molecular weights of the carboxylic acids (I) and (II) are between 170 and 100,000. Preferred products are those which lie to the extent of more than 90% in the molecular weight range between 170 and 10,000, and particularly preferably between 300 and 10,000. The carboxylic acids (I) and (II) and preferred starting substances are described in German Offenlegungsschrift 2,626,430.

Compounds of the formulae (I) and (II) which are to be singled out in particular are esters of dicarboxylic acids of the formula $$HOCO—R_2—COOH \qquad III$$

or anhydrides thereof, wherein $R_2$ represents $C_1$–$C_4$-alkylene, —CH=CH—, O—, m-or p-phenylene, $C_2$- or $C_3$-alkylene: which is substituted by $NH_2$ or a direct bond and either polyhydroxy compounds of the formulae $$HO—(\underset{|}{\overset{R^3}{C}}H—\underset{|}{\overset{R^4}{C}}H—O—)_dH \quad \text{or} \qquad IV$$

$$HO—\underset{|}{\overset{R^4}{C}}H—\underset{|}{\overset{R^3}{C}}H—\underset{|}{\overset{R^1}{N}}—\underset{|}{\overset{R^3}{C}}H—\underset{|}{\overset{R^4}{C}}H—OH \qquad V$$

wherein $R^1$ has the abovementioned meaning, $R^3$ and $R^4$ represents hydrogen or methyl and d represents 1–8, or polyhydric alcohols, such as glycerol, trimethylolpropane or sorbitol.

The compounds b) containing amino groups can also contain ether, ester, carboxylic acid amide and/or urethane groups. They are known from the abovementioned literature. Their preferred molecular weights are 300–12,000, in particular 300–3,000.

Components b) which may be mentioned are, in particular, polyethers which contain amino groups and are prepared by addition of ethylene oxide and/or propylene oxide onto mono-, di- or polyamines with primary or secondary amino groups or onto alkanolamines. As a rule they contain 1–6 hydroxyl groups.

Monoamines which may be mentioned are: monoalkyl and dialkylamines with $C_1$–$C_{18}$-alkyl groups, cycloaliphatic amines, such as cyclohexylamine and homologues, aniline and N-alkylsanilines as well as aniline derivatives substituted on the benzene nucleus.

Di- and polyamines which may be mentioned are: ethylenediamine, diethylenetriamine, triethylenetetramine, 1,2- and 1,3-propylene-diamine and corresponding dipropylenetriamines and tripropylenetetramines, 1,4-diaminobutane, 1,6-diaminohexane, 3-methyl-1,5-diaminopentane, 1,8-diaminooctane, trimethyl-1,6-diaminohexane (2,2,4 and 2,4,4 isomer mixture), 3,3'-bisaminopropyl -methylamine, N,N'-bis-2-aminoethylpiperazine, 1-amino-3,3,5-trimethyl-5-aminomethylcyclohexane, 4,4'-diamino-dicyclohexylmethane and propane, 1,4-diaminocyclohexane, 2,4- and 2,6-hexahydrotoluylenediamine, 3,3'-dimethyl-4,4'-diamino-dicyclohexylmethane, N,N-dimethyl-ethylenediamine, piperazine, N-methylpiperazine, 4-aminobenzylamine, 4-aminophenylethylamine, o-, m- and p-phenylenediamine, 2,4- and/or 2,6-toluylenediamine, 4,4'-diaminodiphenylmethane, if appropriate mixed with higher aniline/formaldehyde condensates, amines which are obtained by addition of acrylonitrile onto primary monoamines and subsequent reduction, and disecondary amines such as are obtained in the catalytic hydrogenation of diprimary aliphatic diamines in the presence of aldehydes and ketones.

Alkanolamines which may be mentioned are: ethanolamine, diethanolamine, propanolamine, dipropanolamine, dibutanolamine, N-methyldiethanolamine, N-dimethylethanolamine, N-diethylethanolamine and triethanolamine.

Preferred components b) which may be mentioned are also oligourethanes containing amino groups. They are obtained by reacting polyisocyanates, such as 1,4-tetramethylene diisocyanate, 1,6-hexamethylene diisocyanate, 1,12-dodecane diisocyanate, cyclohexane 1,3- and 1,4-diisocyanate, 1-isocyanato-3,3,5-trimethyl-5-isocyanatomethyl -cyclohexane, 2,4- and 2,6-hexahydrotoluylene diisocyanate, hexahydro-1,3- and -1,4-phenylene diisocyanate, perhydro-2,4'- and -4,4'-diphenylmethane diisocyanate, 1,3- and 1,4-phenylene diisocyanate,2,4- and 2,6-toluylene diisocyanate, diphenylmethane 2,4'- and 4,4'-diisocyanate, naphthylene 1,5-diisocyanate and triphenylmethane 4,4',4''-triisocyanate, with mono- or polytertiary alkanolamines, in particular with mono-hydroxyalkyl- or di-hydroxyalkylamines, such as dimethylaminoethanol, dimethylaminopropanol, diethylaminoethanol, diethylaminopropanol, N-hydroxyethylpyrrolidine, N-hydroxyethylpiperidine, N-methyldiethanolamine, N-ethyldiethanolamine and N-methyldiisopropanolamine.

Particularly preferred components b) are those of the formula

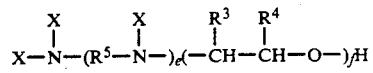

VI wherein

X denotes $C_1$–$C_4$-alkyl or

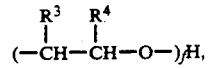

$R^3$ and $R^4$ denote hydrogen or methyl, $R^5$ denotes $C_2$–$C_6$-alkylene, e denotes 0–10 and f denotes 1–100, and reaction products thereof with diisocyanates.

The processes for the treatment of leather are carried out by known methods in, for example, tanning vats or tanning mixers. The temperatures are in general 10°–90° C., preferably 20°–60° C. The aqueous treatment liquors advantageously contain a total of 0.5–20% by weight of components a) and b).

The agents according to the invention can be used at various points in the treatment or production of leather. For example, they can be used for retanning chrome-tanned and vegetable-tanned leather or simultaneously with chrome tanning agents or replacement tanning agents. However, they can also be used in the dye liquor or during fat liquoring.

By joint treatment with the anionic compounds a) and the cationic compounds b), different charging conditions on the leather surface are compensated and deeper penetration into the leather is avoided. An effect called seasoned dubbing in the leather industry is thereby achieved. At the same time, because the agents sit relatively superficially, dyeings of good levelness, brilliance and depth and a good exhaustion of the dye liquor is achieved. Soft, smooth leather with a good grain is obtained.

In contrast, when components a) and b) are used individually—as is known—they penetrate deeply into the leather and cause a leather surface of non-uniform charge. The dyeings thereby become less level.

EXAMPLES

1. Preparation of the Starting Materials

EXAMPLE 1.1

1,117 g of diethylethanolamine and 1,500 ml of toluene are initially introduced into a glass flask equipped with a device for azeotropic dehydration, and the air is replaced by nitrogen. 100 g of 50% strength aqueous potassium hydroxide solution are added at 80° C. and 66 g of water are removed from the reaction mixture by azeotropic distillation at 100°–115° C. 8,883 g of ethylene oxide are then slowly metered in at 90°–100° C. under 1.4–1.6 bar of nitrogen and the mixture is subsequently stirred at 100° C. for 3 hours. 1,000 g of water are added to the alkaline reaction product and the mixture is neutralized with 350 g of 12.5% strength aqueous sulphuric acid. After addition of 0.05% of 2,6-bis-t-butyl-p-cresol, the water is subsequently distilled off in vacuo at 70°–90° C. and the salts which have separated out are filtered off. The colourless wax thus obtained has an OH number of 80, a viscosity of $\eta$ 50° C.=56 mPas and a molecular weight of 1,047.

Example 1.2

900 g of diethylethanolamine are initially introduced into a glass flask and the air is replaced by nitrogen. 100 g of 50% strength aqueous potassium hydroxide solution are added at 80° C. and 66 g of water are removed from the reaction mixture by vacuum distillation at 100° C. 6,946 g of propylene oxide are then slowly metered in at 100°–105° C. under 1.4–1.6 bar of nitrogen. The mixture is subsequently stirred at 105° C. for 4 hours. 1,138 g of phthalic anhydride are then added. After a further 2 hours, 1,015 g of ethylene oxide are slowly metered in at 105° C. After a subsequent reaction for a further 4 hours, the mixture is neutralized and 0.05% of 2,6-bis-t-butyl-p-cresol is added. After the water has been distilled off, the salts which have separated out are filtered off. A polyether containing ester groups and with an OH number of 40, a viscosity of $\eta$ 25° C. = 1,000 mPas and a molecular weight of 1,300 is obtained.

2. Preparation of the Mixtures According to the Invention

Example 2.1

200 g of the polyether from Example 1.1 (0.19 mole) are mixed with 250 g (0.44 mole) of a condensation product, prepared according to German Offenlegungsschrift 2,626,430, of 1 mole of octaethylene glycol and 2 moles of maleic anhydride in 300 g of water at 40° C., with stirring, and the pH is brought to 3.5 with aqueous ammonia.

Example 2.2

250 g (0.38 mole) of a condensation product, prepared according to German Offenlegungsschrift 2,626,430, of 1 mole of octaethylene glycol and 2 moles of phthalic anhydride are dissolved in 1,500 g of water. 1,000 g (0.81 mole) of an oligourethane, prepared according to German Auslegeschrift 2,504,081, of 2 moles of octaethylene glycol, 1 mole of N-propyl-di-propanolamine and 1.8 moles of 2,4-/2,6-toluylene diisocyanate are added to this solution. The hydrosol formed is brought to pH 9 with formic acid.

Example 2.3

800 g (0.62 mole) of the product from Example 1.2 are stirred into 800 g of water and 1,000 g of a compound, prepared according to German Offenlegungsschrift 2,626,430, of 1 mole of a mixture of tetra- to decaethylene glycol with 2 moles of maleic anhydride are added. The pH is brought to 4.2 with about 400 g of 25% strength ammonia.

Example 2.4

56.3 g (0.05 mole) of a propylene oxide polyether started from triethanolamine and with a molecular weight of 1,125 and 92.8 g (0.1 mole) of an oligourethane, prepared according to German Auslegeschrift 2,504,081, of 2 moles of tetraethylene glycol, 1 mole of methyl-diethanolamine and 2 moles of isophoron diisocyanate are mixed with 56.6 g (0.1 mole) of a condensation product, prepared according to German Offenlegungsschrift 2,626,430, of 1 mole of octaethylene glycol and 2 moles of maleic anhydride in 200 g of water at 40° C., with stirring. The pH is brought to 4.8 with aqueous ammonia.

3. Use of the Mixtures According to the Invention

The % data relate to the weight of the leather

Example 3.1 (Suede Leather)

Procedure A

Wet blue split hides of various origins are worked in 50% of water, warmed to 50° C., with the aid of 1% of a mixture of non-ionic emulsifiers.

After 30 minutes, the liquor is drained off, the leather is rinsed at 40° C. for 10 minutes, 50% of water, warmed to 40° C., are added and, after 20 minutes, 2% of the mixture according to Example 2.1, 2.2, 2.3 or 2.4 is added, 4% of a self-buffering chrome tanning agent (®BAYCHROM CL) are added, 1% of sodium formate is added after 60 minutes and 2% of sodium bicarbonate is added after 10 minutes, the process is allowed to run for 60 minutes, preliminary fat liquoring is carried out, the liquor is drained off and the leather is rinsed.

100% of water of 50° C. is then taken and 1% of ammonia is added and, after 5 minutes, dyeing is carried out with 3% of Acid Brown 83 (C.I. 20 250), the mixture is acidified with 3% of formic acid after 60 minutes and the process is allowed to run for another 30 minutes. The leather is finished in the customary manner.

Procedure B

The chrome tanning described above is carried out without the addition of a mixture according to the invention. 1% of the mixture according to Example 2.1, 2.2, 2.3 or 2.4 is first added to the dye liquor after dyeing. The after-treatment time is 20 minutes.

Leather with an excellent levelness of colour and depth of colour, a level nap, open fibres and a smooth, slightly lardy handle with a written effect (surface gloss) is obtained by both procedures.

Example 3.2 (Upper Leather)

The % data relate to the shaved weight Procedure A

For retanning, 100% of water of 40° C. and 2% of a neutralization tanning agent with a strongly buffering action (®TANTIGAN PC) are added to chrome cowhide (commercial class II; shaved 1.6–1.8 mm) until a pH value of 4.5 is reached. After 45 minutes, 3% of a polyacrylate retanning agent containing carboxyl groups (®BAYTIGAN AR) is added. After 20 minutes, 2% of the mixtures according to Example 2.1, 2.2, 2.3 or 2.4 is added. After a further 30 minutes, 4% of a synthetic replacement tanning agent based on phenol (®TANIGAN LD) is added. After 45 minutes, the liquor is drained off and the leather is rinsed with water of 50° C. for 10 minutes. For dyeing, 100% of water of 50° C. and 0.8% of Acid Brown 83 (C.I. 20.250) and 0.2% of Acid Brown 85 (C.I. 34.900) are introduced into the vat; the running time is 20 minutes. After fat liquoring carried out in a known manner, the dyestuff is fixed by treatment with formic acid for 20 minutes. The leather is finished in the customary manner. Procedure B The mixtures according to Example 2.1, 2.2, 2.3 or 2.4 are added to the fat liquoring and not to the retanning as in A. The procedure is otherwise as described under A.

Leather with firmness of grain, softness, fullness, levelness of colour and depth of colour is obtained by both procedures.

We claim:

1. Agents for the treatment of leather, comprising a mixture of a) an ester prepared from a carboxylic acid of the formula $$HOOC-R_2-COOH$$

or the anhydride thereof, wherein $R_2$ represents $C_1$–$C_4$-alkylene, and a polyhydroxy compound of the formula $$HO\left(\overset{R^3}{\overset{|}{C}H}-\overset{R^4}{\overset{|}{C}H}-O\right)_dH$$

wherein $R^3$ and $R^4$ independently represent hydrogen or methyl, and d represents 1–8;

and b) a compound containing at least one amino group and containing an ether group with a molecular weight of 300–12,000 and which is prepared by addition of ethylene oxide and/or propylene oxide onto alkanolamines, the weight ratio of components a) :b) being 5:95 to 95:5.

2. Agents according to claim 1, comprising aqueous solutions of components a) and b) with a total concentration of 20–60% by weight and a pH value of 1.5–10.

3. Agents according to claim 1, wherein component b) is a compound of the formula $$X-\overset{X}{\overset{|}{N}}-(R^5-\overset{X}{\overset{|}{N}}-)_e\left(-\overset{R^3}{\overset{|}{C}H}-\overset{R^4}{\overset{|}{C}H}-O-\right)_fH$$

wherein

X denotes $C_1$–$C_4$-alkyl or $$\left(-\overset{R^3}{\overset{|}{C}H}-\overset{R^4}{\overset{|}{C}H}-O-\right)_fH$$

$R^3$ and $R^4$ denote hydrogen or methyl, $R^5$ denotes $C_2$–$C_6$-alkylene, e denotes 0–10 and f denotes 1–100.

4. A process for tanning, pretanning, retanning, dyeing or fat liquoring pelts or pretanned or fully tanned leather, wherein said process is carried out in the presence of agents according to claim 1.

5. A process according to claim 4, wherein the treatment is carried out with an aqueous liquor containing 0.5–20% by weight of agents according to claim 1.

6. Leathers obtained by treatment with an agent according to claim 1.

* * * * *